US006709097B2

(12) United States Patent
Nakahara et al.

(10) Patent No.: US 6,709,097 B2
(45) Date of Patent: Mar. 23, 2004

(54) INK JET RECORDING MEDIUM

(75) Inventors: Katsumasa Nakahara, Chiba (JP); Takuya Nakao, Chiba (JP); Hiroyuki Fujii, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/100,910

(22) Filed: Mar. 20, 2002

(65) Prior Publication Data

US 2002/0171730 A1 Nov. 21, 2002

(30) Foreign Application Priority Data

Mar. 21, 2001 (JP) ..... 2001-080955
Jun. 12, 2001 (JP) ..... 2001-177192

(51) Int. Cl.[7] ..... B41J 2/01
(52) U.S. Cl. ..... 347/105; 347/101; 428/195
(58) Field of Search ..... 347/105, 101, 347/1; 428/195

(56) References Cited

U.S. PATENT DOCUMENTS

| | | | | | |
|---|---|---|---|---|---|
| 4,460,637 | A | | 7/1984 | Miyamoto et al. | |
| 5,612,281 | A | * | 3/1997 | Kobayashi et al. | 428/195 |
| 5,635,291 | A | * | 6/1997 | Yoshino et al. | 347/105 |
| 5,955,185 | A | * | 9/1999 | Yoshino et al. | 347/105 |
| 5,985,076 | A | * | 11/1999 | Misuda et al. | 156/230 |
| 6,187,419 | B1 | | 2/2001 | Kijimuta et al. | |
| 6,238,047 | B1 | * | 5/2001 | Suzuki et al. | 347/105 |
| 6,517,929 | B1 | * | 2/2003 | Shibatani et al. | 428/195 |

FOREIGN PATENT DOCUMENTS

| | | | | |
|---|---|---|---|---|
| EP | 0 218 956 | | 4/1987 | |
| EP | 0218956 | A1 * | 4/1987 | B41M/1/36 |
| EP | 0 705 710 | | 4/1996 | |
| EP | 0803374 | A2 * | 4/1997 | B41M/5/00 |
| EP | 0 803 374 | | 10/1997 | |
| EP | 0803374 | A2 * | 10/1997 | B41M/5/00 |
| EP | 1 010 666 | | 6/2000 | |
| EP | 1 112 962 | | 7/2001 | |

OTHER PUBLICATIONS

Derwent Publications, AN 1994–346797, XP–002200699, JP 06 270530, Sep. 27, 1994.

* cited by examiner

*Primary Examiner*—Stephen D. Meier
*Assistant Examiner*—Manish Shah
(74) *Attorney, Agent, or Firm*—Oblon, Spivak, McClelland, Maier & Neustadt, P.C.

(57) ABSTRACT

An ink jet recording medium including a substrate, an ink receiving layer containing fine inorganic particles, formed on the substrate and a layer containing silica/alumina composite particles, formed on the ink receiving layer, wherein the layer containing silica/alumina composite particles, is a layer containing a xerogel having an average pore radius of at least 6.0 nm, obtained by removing a solvent from a silica/alumina composite sol containing agglomerated particles including silica and alumina.

8 Claims, No Drawings

INK JET RECORDING MEDIUM

CROSS REFERENCE TO RELATED APPLICATIONS

The entire disclosures of Japanese Patent Application No. 2001-080955 filed on Mar. 21, 2001 and Japanese Patent Application No. 2001-177192 filed on Jun. 12, 2001 including specifications, claims and summaries are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a recording medium, particularly to a recording medium suitable for an ink a jet printer.

2. Discussion of the Background

An ink jet recording system is a system wherein ink droplets are jetted at a high velocity from a nozzle to form an image directly on a recording medium. A printer employing such an ink jet system has found remarkable widespread use in recent years, since it can easily be small-sized, it is easy for full coloring or high speed modification, or its printing noise is low.

As a recording medium for an ink jet printer, one having a porous ink receiving layer comprising fine inorganic particles such as silica or alumina and a binder such as polyvinyl alcohol, formed on a substrate such as a paper or a film in order to quickly absorb ink and to obtain a clear image, has been known. The recording medium for an ink jet printer is required to absorb the solvent contained in a large quantity in the ink by pores in the ink receiving layer, and accordingly, the ink receiving layer is required to have pores with a large pore radius and a large pore volume. Further, as the ink receiving layer is more transparent, a clearer image having a high color density can be formed, and accordingly, the ink receiving layer is preferably one having good transparency.

Further, in addition to the above-mentioned ink absorptivity and transparency, it has become important that, as an aqueous ink is used in an ink jet recording system, even when a recorded product is in contact with water, no running of ink should take place as a result of flowing of a dye in the ink (hereinafter referred to as water resistance), or even if the surface of the recording medium is in contact with a hard object, it should be free from receiving scratches and thus free from impairment of the quality of the recorded product (hereinafter referred to as scratch resistance), or the surface gloss is high (hereinafter referred to as glossiness).

In order to cope with these requirements, many ink jet recording media have heretofore been proposed. JP-A-2000-21892 discloses a recording sheet having a high color density and gloss, which comprises a substrate, a porous layer containing boehmite, formed on the substrate, and a porous layer having composite particles comprising silica and alumina bound by a binder, formed on the porous layer containing boehmite. The process for producing such a recording sheet is a process wherein a coating fluid composed of a composite sol comprising silica and alumina, is coated and then dried as pressed against a die having a smooth surface. Accordingly, such a process is applicable to a case where a paper is used as the substrate as in Examples given in the publication, but it can not be applied in the case of a water-impermeable substrate such as a resin film or a resin coated paper having a polyolefin resin coating layer (so-called RC paper), since the solvent in the coating fluid can not be thereby evaporated and removed at the time of drying.

Further, JP-A-2000-351267 discloses a recording medium for pigment ink, which comprises a substrate, an ink receiving layer containing boehmite, formed on the substrate, and a layer formed from a coating fluid containing oxide particles such as alumina ultra fine particles or silica particles treated with aluminum polychloride, having an average particle size of from 10 to 200 nm, and having a pH of from 3 to 11, laminated on the ink receiving layer.

BRIEF SUMMARY OF THE INVENTION

It is an object of the present invention to provide an ink jet recording medium which has ink absorptivity suitable for ink jet recording and which is suitable for recording in high color density and further is excellent in water resistance, scratch resistance and glossiness.

The present invention provides an ink jet recording medium comprising a substrate, an ink receiving layer containing fine inorganic particles, formed on the substrate and a layer containing silica/alumina composite particles, formed on the ink receiving layer, wherein the layer containing silica/alumina composite particles, is a layer containing a xerogel having an average pore radius of at least 6.0 nm, obtained by removing a solvent from a silica/alumina composite sol containing agglomerated particles comprising silica and alumina.

The layer containing silica/alumina composite particles, is a layer obtained by removing a solvent from a silica/alumina composite sol containing agglomerated particles comprising silica and alumina as colloidal particles. The silica or alumina may be hydrate of silicon oxide or hydrate of aluminum oxide respectively. The coating fluid obtained by mixing the silica/alumina composite sol, a binder and a solvent, preferably forms a porous layer having the silica/alumina composite particles bound by the binder (hereinafter referred to as a composite particle layer).

In the present invention, the xerogel used for the composite particle layer is required to have an average pore radius of at least 6.0 nm. The xerogel is obtained by removing the solvent from the silica/alumina composite sol. The pore characteristics are measured by a nitrogen absorption desorption method. The average pore radius is a value obtained by calculation by $(2V/A\times10^3$ (nm), where V is the total pore volume ($cm^3/g$) and A is the specific surface area ($m^2/g$). If the average pore radius of the xerogel obtained by removing the solvent from the silica/alumina composite sol, is less than 6.0 nm, the ink absorptivity of the composite particle layer tends to be inadequate, such being undesirable. The average pore radius of the xerogel is preferably within a range of from 6.0 to 15 nm, more preferably from 6.5 to 12 nm, particularly preferably from 7.0 to 10 nm.

The specific surface area of the xerogel is preferably from 50 to 200 $m^2/g$. If the specific surface area is smaller than 50 $m^2/g$, not only the fixing property of the dye in the ink tends to be poor, but also the glossiness and the transparency of the composite particle layer tend to be poor, and it tends to be difficult to obtain a recording medium having a high color density and glossiness. Further, if the specific surface area exceeds 200 $m^2/g$, it tends to be difficult to obtain a large average pore radius, and it tends to be difficult to obtain a recording medium having good ink absorptivity. A more preferred range of the specific surface area is from 60 to 140 $m^2/g$. By adopting the specific surface area within such a specific range, it is possible to obtain a recording medium which is excellent in glossiness and color density and which is excellent also in ink absorptivity.

In the present invention, the composite particle layer is formed on the ink receiving layer, whereby a recording medium excellent in ink absorptivity, image color density, water resistance, scratch resistance and glossiness, can be obtained. In particular, it is possible to obtain a recording medium of a high quality having a high color density and high glossiness, which is free from beading in a printing test which will be described hereinafter.

BRIEF DESCRIPTION OF THE DRAWINGS

Not Applicable

DETAILED DESCRIPTION OF THE INVENTION

Now, the present invention will be described in detail with reference to the preferred embodiments.

In the present invention, the silica/alumina composite sol is preferably a colloidal solution obtained by adding to a silica sol an aluminum salt which shows acidity when dissolved in water, wherein the average particle size of agglomerated particles is from 50 to 200 nm. If the average particle size of the agglomerated particles exceeds 200 nm, the transparency of the composite particle layer tends to decrease, and the color density of an image tends to be low, such being undesirable. On the other hand, if it is smaller than 50 nm, although the transparency is good, the average pore radius tends to be small, and the ink absorptivity tends to be poor, such being undesirable. When the agglomerated particle size is within this range, the average pore radius when formed into the xerogel, can be made large, and it is possible to form a composite article layer which satisfies both the ink absorptivity and the transparency.

The silica in the agglomerated particles in the silica/alumina composite sol is preferably such that the primary particles are spherical, and the average particle size of the primary particles is from 20 to 70 nm. The recording medium of the present invention has high scratch resistance, since the primary particles of silica in the silica/alumina composite sol are spherical. If the average particle size of the primary particles of silica is smaller than 20 nm, when the silica/alumina composite sol is dried, it tends to be difficult to obtain a xerogel having a large average pore radius, and the ink absorptivity of the composite particle layer tends to be inadequate, such being undesirable. On the other hand, if the average particle size of the primary particles of silica exceeds 70 nm, the specific surface area of the silica/alumina composite particles tends to be small, whereby not only the fixing property for a dye tends to be inadequate, but also the glossiness and transparency of the composite particle layer tend to be poor, and it tends to be difficult to obtain a recording medium having high color density and glossiness, such being undesirable. A more preferred range of the average particle size of the primary particles of silica is from 20 to 60 nm. By adjusting the average particle size of silica in the silica sol to be used as the raw material within such a specific range, the specific surface area of the xerogel obtainable by drying the silica/alumina composite sol can be brought within the above-mentioned specific range, and it is possible to obtain a recording medium which is excellent in glossiness and color density and which is excellent also in ink absorptivity. The average particle size of the primary particles of silica is measured by a transmission electron microscope.

The silica/alumina composite sol preferably has a pH of from 3 to 9. If the pH is higher than 9, the zeta potential of the agglomerated particles tends to be low, such being undesirable. On the other hand, if the pH is lower than 3, the alumina tends to be dissolved, such being undesirable. The silica/alumina composite sol preferably has a zeta potential of agglomerated particles of +10 mV or higher, whereby the fixing property for an anionic dye to be used for e.g. an ink jet printer, will be high. A more preferred range of the zeta potential is from +30 to +90 mV.

With the silica/alumina composite sol, as the amount of alumina increases relative to silica, the zeta potential of agglomerated particles tends to be high. The amount of alumina is preferably an amount whereby the zeta potential of agglomerated particles becomes +10 mV or higher. To the silica sol as the raw material, it is necessary to add alumina in a larger amount, as the specific surface area of the xerogel obtainable by removing the solvent, is larger. It is preferred to add at least 1 g as $Al_2O_3$ per 100 g of the $SiO_2$ component in the silica sol.

With respect to the coated amount of the composite particle layer, it is preferred that the total amount of the silica/alumina composite particles and the binder after drying per unit area is preferably from 0.1 to 10 $g/m^2$. If the coated amount is less than 0.1 $g/m^2$, no adequate image color density, water resistance, scratch resistance or glossiness tends to be obtainable, such being undesirable. On the other hand, if the coated amount exceeds 10 $g/m^2$, the strength of the composite particle layer tends to deteriorate, such being undesirable.

The recording medium of the present invention has an ink receiving layer containing fine inorganic particles (hereinafter referred to as a lower layer to distinguish it from the composite particle layer) beneath the composite particle layer. As the fine inorganic particles in the lower layer, it is preferred to employ alumina hydrate, alumina or silica, whereby a porous layer having a large pore volume can be formed, and the ink absorptivity is excellent.

To form such a lower layer, a coating fluid comprising the fine inorganic particles, a binder and a solvent, is coated on a substrate, followed by drying to form a porous lower layer. It is preferred to form a porous layer containing alumina as the lower layer, whereby not only the ink absorptivity but also the fixing property for a dye will be excellent. Further, alumina hydrate such as boehmite is more preferred, since it is excellent not only in the ink absorptivity and the fixing property for a dye but also in transparency, and recording with a high color density can be attained. As a specific example of the alumina hydrate such as boehmite, an alumina sol or the like disclosed in JP-A-10-231120, may be mentioned.

Further, it is preferred to use silica as the fine inorganic particles for the lower layer, whereby a porous layer having a large pore volume can be formed, and the ink absorptivity is excellent. The fine silica particles are not particularly limited, and wet-process silica or dry-process silica may suitably be employed. Among them, dry-process silica having a primary particle size of at most 30 nm, is particularly preferred, since the primary particle size is small, and it is excellent in dispersibility in water and capable of forming a porous layer excellent in smoothness.

However, since the surface is negatively charged, the fine silica particles do not provide a fixing property for an anionic dye which is commonly used in a dye ink for an ink jet printer, and the water resistance of an image will be poor. Therefore, when fine silica particles are employed as the fine inorganic particles, it is preferred to incorporate a cationic compound such as a cationic polymer. The cationic polymer to be mixed with fine silica particles, is not particularly limited, and a polymer containing a quaternary ammonium salt, may, for example, be mentioned.

With respect to the coated amount of the lower layer, the total amount of the fine inorganic particles and the binder after drying is preferably from 5 to 100 g/m$^2$ of the substrate, from the viewpoint of the ink absorptivity. If the coated amount is less than 5 g/m$^2$, the ink absorptivity tends to be inadequate, such being undesirable. On the other hand, if the coated amount exceeds 100 g/m$^2$, no further improvement in the ink absorptivity will be observed, and not only the mechanical strength tends to deteriorate, but also the material will be wasted, such being undesirable.

The substrate is not particularly limited, and various types may be employed. In addition to papers made mainly of cellulose, synthetic papers, non-woven fabrics, etc., various water-impermeable plastic films of e.g. a polyester resin such as polyethylene terephthalate, a polycarbonate resin, a fluororesin or a polyvinyl chloride resin, and resin-coated papers (hereinafter referred to as RC papers) having a polyolefin resin coating layer on the surface, may, for example, be mentioned. For the recording medium of the present invention, as the substrate, it is preferred to employ a water-impermeable substrate.

Among them, a polyethylene terephthalate film is preferred. Particularly preferred is a white colored polyethylene terephthalate film having a white pigment incorporated, since it is excellent in the surface smoothness, glossiness and durability, and an ink jet film of a high quality can thereby be obtained. Further, a RC paper is also particularly preferred, since it is excellent in the surface smoothness and glossiness, and an ink jet paper having a texture similar to a photographic paper can thereby be obtained.

For both the composite particle layer and the lower layer, the method for coating the coating fluid is not particularly limited, and a method of using a bar coater, a die coater, a gravure coater, an air knife coater, a blade coater, a comma coater, a slide hopper or a curtain coater, may, for example, be mentioned.

For both the composite particle layer and the lower layer, the binder for the coating fluid is not particularly limited, and an organic substance, such as polyvinyl alcohol or its modified product, starch or its modified product, SBR latex, NBR latex, hydroxycellulose, or polyvinyl pyrrolidone, may be employed. In a case where polyvinyl alcohol is employed, it is preferred to add boric acid or a borate such as borax, as a crosslinking agent, as the case requires, whereby the strength of the coated layer may be increased, and cracking of the surface or the like may be prevented.

A method for forming the lower layer and the composite particle layer on the water-impermeable substrate, is not particularly limited. The coating fluid for the lower layer may be coated on the substrate and then dried, whereupon the coating fluid for the composite particle layer may be coated and again dried. Otherwise, the coating fluid for the lower layer and the coating fluid for the composite particle layer may be coated simultaneously on the substrate, and the two layers may simultaneously be dried.

However, in a case where the substrate has low heat resistance, like RC paper, drying can not be carried out at a high temperature. Accordingly, the coating fluid for the lower layer and the coating fluid for the composite particle layer may be coated simultaneously on the substrate and then cooled to immobilize the coated layer by gelation, followed by drying by dry air at a temperature of not higher than 70° C. In order to impart such a nature of gelation upon cooling to the coating fluid, it is necessary to optimize the solid content concentration in the coating fluid or to optionally add a crosslinking agent such as boric acid or borax, depending upon the fine inorganic particles and the binder to be used.

Further, to the coating fluid, an additive to improve ozone resistance or light resistance of an image, may be incorporated, as the case requires.

Now, a method for producing the silica/alumina composite sol will be described. The pH or the solvent for the silica sol as the raw material for the silica/alumina composite sol, are not particularly limited. However, with respect to the solvent, water is preferred from the viewpoint of the simplicity in operation. For example, it is preferred to use a silica sol commercially available such as one known by a trade name Cataloid SI-50, manufactured by Catalysts & Chemicals Industries Co., Ltd. The silica sol may be diluted with water.

As the aluminum salt whereby the solution becomes acidic when dissolved in water, a salt of aluminum hydroxide with a strong acid (hereinafter referred to simply as an acidic aluminum salt) is preferred. The acidic aluminum salt may, for example, be an inorganic salt such as aluminum chloride, aluminum sulfate or aluminum nitrate, or an organic salt such as aluminum acetate. It is preferred that such an acidic aluminum salt is suitably dissolved in water and mixed to the silica sol.

As the acidic aluminum salt, aluminum polychloride is preferred, the aluminum polychloride is a compound represented by the chemical formula $[Al_2(OH)_nCl_{6-n}]_m$($1<n<6$, $m<10$). For example, one commercially available by a trade name such as Takibine #1500 or PAC250A, manufactured by Taki Chemical Co., Ltd., may be mentioned. The aluminum polychloride preferably has a basicity of at least 20%. The basicity is represented by (n/6) in the above-mentioned formula by percentage, and the specific method of measurement is defined by JIS K1475. If the basicity is smaller than 20%, the content of Cl is large relative to Al, such being undesirable when impurity elements are to be removed by e.g. ultrafiltration.

As a method for adding the acidic aluminum salt to the silica sol, it is preferred that a predetermined amount of the acidic aluminum salt is gradually added to the silica sol as the raw material. As the acidic aluminum salt is gradually added to the silica sol, alumina will gradually form and deposit on the surface of silica particles in the sol. As the deposited amount of alumina increases, the surface potential of the sol particles changes from negative to positive. On the way, the potential passes through a state of 0, whereby agglomeration of particles takes place to form agglomerated particles comprising silica and alumina. At the time of adding the acidic aluminum salt, it is preferred to stir the silica sol to prevent local concentration of the acidic aluminum salt. Inversely, if the silica sol as the raw material is gradually added to the solution of the acidic aluminum salt, a sol containing complex particles having alumina deposited on the surface of silica sol particles, may be formed, but agglomerated particles will not substantially be formed. Accordingly, the xerogel obtainable by drying the sol will be one having a small average pore radius. Thus, if an ink receiving layer is formed by using such a sol, the ink absorptivity will be poor, and the fixing property for a dye will be inadequate.

The temperature at the time of mixing the silica sol and the acidic aluminum salt is preferably from 25 to 150° C. If the temperature is lower than 25° C., the reaction speed tends to be slow, and alumina may not be sufficiently deposited on the surface of silica particles, such being undesirable. If the temperature is higher than 150° C., the operation tends to be difficult.

The amount of the acidic aluminum salt to be added, is preferably an amount whereby the zeta potential of particles will be +10 mV or higher. It is necessary to add the acidic aluminum salt in a larger amount, as the specific surface area of the sol particles in the silica sol as the raw material is larger. However, in the case of a silica sol to be used as the raw material wherein the average particle size of primary particles is from 20 to 70 nm, it is preferred to add the acidic aluminum salt in an amount of from 1 to 50 g as calculated as $Al_2O_3$, per 100 g of silica as calculated as $SiO_2$.

Even if the amount of the acidic aluminum salt is excessive, there is no particular problem with respect to the properties of the silica/alumina composite sol thereby obtained. However, the after mentioned operation for removing impurity elements by e.g. ultrafiltration, tends to be difficult, such being disadvantageous.

To the silica sol, another electrolyte may further be incorporated in addition to the acidic aluminum salt, whereby agglomerated particles may be formed more effectively. Such another electrolyte is not particularly limited so long as it has an agglomerating action to the silica sol. For example, sodium chloride, potassium chloride, sodium sulfate, potassium acetate or magnesium nitrate may be mentioned. These electrolytes may be used alone or in combination as a mixture.

The amount of such another electrolyte is preferably from 1 to 70 wt %, based on the weight of silica (calculated as $SiO_2$) in the silica sol as the raw material. The method of adding such an electrolyte is not particularly limited, and such an electrolyte may be preliminarily added to the silica sol, or it may be added to the acidic aluminum salt, and then added to the silica sol. Otherwise, the electrolyte may be added to a mixed solution obtained by adding the acidic aluminum salt to the silica sol.

Then, from the mixed solution after adding the acidic aluminum salt to the silica sol, it is preferred to remove impurity ions such as an unreacted acidic aluminum salt or the added electrolyte. To remove such impurity ions effectively, it is preferred to adjust the pH to from 5 to 10, more preferably from 6 to 8, by adding an alkali such as sodium hydroxide or an acid such as hydrochloric acid, to the mixed solution after adding the acidic aluminum salt to the silica sol. As the method for removal, ultrafiltration is preferred.

In a case where the average particle size of the agglomerated particles of the silica/alumina composite sol synthesized as described above, is larger than 200 nm, it is adjusted to a level of from 50 to 200 nm by adding a peptitizer or by carrying out ultrasonic dispersion. Peptitizer is not particularly limited, and an inorganic acid such as hydrochloric acid, nitric acid, sulfuric acid or amide sulfuric acid, or an organic acid such as acetic acid, may suitably be used. These peptitizers may be used alone or in combination as a mixture.

EXAMPLES

Now, the present invention will be described in further detail with reference to Examples. However, it should be understood that the present invention is by no means restricted to such specific Examples.

Firstly, three types of silica/alumina composite sols A, B and C to be used for the upper layer, were synthesized. Further, an alumina sol to be used for the lower layer was synthesized in the same method as in JP-A-10-231120. The methods for their preparation are shown below.

Preparation of Silica/alumina Composite Sol A for the Upper Layer

Into a glass reactor having a capacity of 2 l, 248 g of a silica sol ($SiO_2$ concentration: 48.4 mass %, $Na_2O$ concentration: 0.41 mass %, Cataloid SI-50, trade name, manufactured by Catalysts & Chemicals Industries Co., Ltd.) in which spherical primary particles of silica having an average particle size of the primary particles of 27 nm were dispersed, and 1688 g of deionized water, were introduced and heated to 80° C. When the temperature reached 80° C., 63.7 g of an aqueous aluminum polychloride solution (aluminum concentration calculated as $Al_2O_3$: 23.5 mass %, Cl concentration: 8.1 mass %, basicity: 84%, Takibine #1500, trade name, manufactured by Taki Chemical Co.) was gradually added over a period of about 10 minutes with stirring.

After completion of the addition, stirring was continued for one hour while maintaining the temperature at 80° C. Then, an aqueous sodium hydroxide solution was added to this reaction solution to adjust the pH of the reaction solution to 7.3 (at 80° C). Then, the reaction solution was cooled and purified by means of an ultrafiltration apparatus by carrying out ultrafiltration until the electrical conductivity of the filtrate decreased to a level of not higher than 50 $\mu$S/cm while maintaining the amount of the liquid constant by adding deionized water. Then, as a peptitizer, an amide sulfuric acid was added in an amount of 3% based on the total solid content amount in the purified solution, followed by concentration under heating under reduced pressure until the total solid content concentration became 30%. Finally, ultrasonic dispersion was carried out to obtain silica/alumina composite sol A having a pH of 5.7 and an average particle size of agglomerated particles of 147 nm.

This silica/alumina composite sol A was dried to obtain a xerogel, the pore characteristics of the xerogel were such that the specific surface area was 97 $m^2/g$ and the average pore radius was 7.6 nm.

Preparation of Silica/alumina Composite Sol B for the Upper Layer

Into a glass reactor having a capacity of 2 l, 299 g of a silica sol ($SiO_2$ concentration: 40.2 mass %, $Na_2O$ concentration: 0.42 mass %, Cataloid SI-45P, trade name, manufactured by Catalysts & Chemicals Industries Co., Ltd.) in which spherical primary particles of silica having an average particle size of primary particles of 41 nm were dispersed, and 1663 g of deionized water, were introduced and heated to 80° C. When the temperature reached 80° C., 38.3 g of an aqueous aluminum polychloride (aluminum concentration calculated as $Al_2O_3$: 23.5 mass %, Cl concentration: 8.1 mass %, basicity: 84%, Takibine #1500, trade name, manufactured by Taki Chemical Co.) was gradually added over period of about 10 minutes with stirring.

After completion of the addition, stirring was continued for one hour while maintaining the temperature at 80° C.

Then, an aqueous sodium hydroxide solution was added to this reaction solution to adjust the pH of the reaction solution to 7.3 (at 80° C.). Then, the reaction solution was cooled and purified by means of an ultrafiltration apparatus by carrying out ultrafiltration until the electrical conductivity of the filtrate decreased to a level of not higher than 50 pS/cm, while maintaining the amount of the liquid to be constant by adding deionized water. Then, as a peptitizer, amide sulfuric acid was added in an amount of 2%, based on the total solid content amount in the purified solution, followed by concentration under heating and under reduced pressure until the total solid content concentration became 30%. Finally, ultrasonic dispersion was carried out to obtain silica/alumina composite sol B having a pH of 5.8 and an average particle size of agglomerated particles of 148 nm.

This silica/alumina composite sol B was dried to obtain a xerogel, and the pore characteristics of the xerogel were such that the specific surface area was 72 $m^2/g$, and the average pore radius was 9.7 nm.

Preparation of Silica/alumina Composite Sol C for the Upper Layer

Into a glass reactor having a capacity of 2 l, 297 g of a silica sol ($SiO_2$ concentration: 40.4 mass %, $Na_2O$ concentration: 0.38 mass %, Cataloid SI-80P, trade name, manufactured by Catalysts & Chemicals Industries Co., Ltd.) in which spherical primary particles of silica having an average particle size of primary particles of 80 nm were dispersed, and 1671 g of deionized water, were introduced and heated to 80° C. When the temperature reached 80° C., 31.9 g of an aqueous aluminum polychloride (aluminum concentration calculated as $Al_2O_3$: 23.5 mass %, Cl concentration: 8.1 mass %, basicity: 84%, Takibine #1500, trade name, manufactured by Taki Chemical Co.) was gradually added over a period of about 10 minutes with stirring.

After completion of the addition, stirring was continued for one hour while maintaining the temperature at 80° C. Then, an aqueous sodium hydroxide solution was added to this reaction solution to adjust the pH of the reaction solution to 7.3 (at 80° C). Then, the reaction solution was cooled and purified by means of an ultrafiltration apparatus by carrying out ultrafiltration until the electrical conductivity of the filtrate decreased to a level of not higher than 50 $\mu$S/cm, while maintaining the amount of the liquid to be constant by adding deionized water. Then, as a peptitizer, amide sulfuric acid was added in an amount of 3% based on the total solid content amount in the purified solution, followed by concentration under heating and under reduced pressure until the total solid content concentration became 30%. Finally, ultrasonic dispersion was carried out to obtain silica/alumina composite sol having a pH of 4.6 and an average particle size of agglomerated particles of 124 nm.

This silica/alumina composite sol was dried to obtain a xerogel, and the pore characteristics of the xerogel were such that the average pore radius was sufficiently large at a level of 14.1 nm, but the specific surface area was small at a level of 34 $m^2/g$.

Preparation of Alumina Sol for the Lower Layer

Into a glass reactor having a capacity of 2 l, 327 g of an aqueous aluminum polychloride (aluminum concentration calculated as $Al_2O_3$: 23.5 mass %, Cl concentration: 8.1 mass %, basicity: 84%, Takibine #1500, trade name, manufactured by Taki Chemical Co.) and 1548 g of water, were charged and heated to 95° C. Then, 125 g of a commercially available aqueous solution of sodium aluminate ($Al_2O_3$: 20 mass %, $Na_2O$: 19 mass %) was added, and the mixture was aged for 24 hours by maintaining it at a liquid temperature of 95° C. with stirring, to obtain a slurry. The pH of the liquid immediately after the addition of the sodium aluminate solution was 8.7 at 95° C.

The slurry after the aging was washed by means of an ultrafiltration apparatus and then again heated to 95° C., and amide sulfuric acid was added in a amount of 3% based on the total solid content amount of the slurry after the washing, followed by concentration under reduced pressure until the total solid content concentration became 25%. Then, ultrasonic dispersion was carried out to obtain an alumina sol having a pH of 3.8 and an average particle size of agglomerated particles of 190 nm.

Example 1

To 100 parts by mass (solid content) of the alumina sol, 10 parts by mass (solid content) of an aqueous solution of polyvinyl alcohol (MA26-GP, manufactured by Shin-Etsu Chemical Co., Ltd.) was added, and water was added thereto to obtain a coating fluid having a total solid content concentration of 20 mass %. This coating fluid was coated on a white PET film having a thickness of 125 $\mu$m (U51LY, trade name, manufactured by Teijin DuPont) by means of a die coater and then dried by hot air at 140° C. to form a lower layer made of alumina hydrate. The coated amount of this lower layer after drying was 37 $g/m^2$.

Then, to 100 parts by mass (solid content) of the silica/alumina composite sol A, 8 parts by mass (solid content) of an aqueous solution of polyvinyl alcohol (MA26-GP, manufactured by Shin-Etsu Chemical Co., Ltd.) was added, and water was added thereto to obtain a coating fluid having a total solid content concentration of 10 mass %. This coating fluid was coated on the lower layer by means of a die coater and then again dried by hot-air of 140° C. to obtain an ink jet recording medium. The coated amount of this upper layer after drying was 2.0 $g/m^2$.

Example 2

To 100 parts by mass (solid content) of the alumina sol, 8 parts by mass (solid content) of an aqueous solution of polyvinyl alcohol (MA26-GP, manufactured by Shin-Etsu Chemical Co., Ltd.), 0.5 part by mass (solid content) of boric acid and 0.25 part by mass (solid content) of borax, were added, and water was added thereto to obtain a coating fluid for a lower layer, having a total solid content concentration of 20 mass %.

Then, to 100 parts by mass (solid content) of the silica/alumina composite sol A, 4 parts by mass (solid content) of an aqueous solution of polyvinyl alcohol (MA26-GP, manufactured by Shin-Etsu Chemical Co., Ltd.), 1.3 parts by mass (solid content) of boric acid and 0.7 part by mass (solid content) of borax were added, and water was added thereto to obtain a coating fluid for an upper layer, having a total solid content concentration of 22 mass %. The coating fluid for a lower layer and the coating fluid for an upper layer were simultaneously coated on a RC paper (product type CPF-170VE, manufactured by Mitsubishi Paper Mills Limited) by means of a slide hopper, so that the coated amounts after drying would be 35 $g/m^2$ for the lower layer and 1 $g/m^2$ for the upper layer and then cooled to 5° C., whereby the coated layers were gelled (immobilized). Then, the coated layers were dried by dry air of 50° C. to obtain an ink jet recording medium.

Example 3

To the silica/alumina composite sol B, an aqueous solution of polyvinyl alcohol (MA26-GP, manufactured by Shin-Etsu Chemical Co., Ltd.), boric acid and borax were added in a ratio such that the solid content ratio would be 100:4:1.6:0.4, and water was further added thereto to obtain a coating fluid for an upper layer, having a total solid content concentration of 20 mass %. On the same substrate as in Example 2, the same coating fluid for a lower layer as in Example 2 and the above coating fluid for an upper layer, were simultaneously coated by means of a slide hopper, so that the coated amounts after drying would be 35 g/m$^2$ for the lower layer and 3 g/m$^2$ for the upper layer and then cooled to 5° C., whereby the coated layers were gelled and immobilized. Then, the coated layers were dried by dry air of 50° C. to obtain an ink jet recording medium.

Example 4

An ink jet recording medium was obtained in the same manner as in Example 1 except that the silica/alumina composite sol C was used instead of the silica/alumina composite sol A.

Comparative Example 1

An ink jet recording medium was obtained in the same manner as in Example 1 except that silica treated with aluminum polychloride having an average particle size of 129 nm, as disclosed in Example 1 of JP-A-2000-351267, was used instead of the silica/alumina composite sol A. The specific surface area of a xerogel obtained by drying this silica treated with aluminum polychloride, was 163 m$^2$/g, but the average pore radius was as small as 5.5 nm.

Comparative Example 2

An ink jet recording medium was obtained in the same manner as in Example 1 except that ultrafine particles of alumina having an average particle size of 33 nm, as disclosed in Example 2 of JP-A-2000-351267 (NanoTek, trade name, manufactured by C.I. Kasei Co., Ltd.) was used instead of the silica/alumina composite sol A. With this ultrafine particles of alumina, the specific surface area was 97 m$^2$/g, but the average pore radius was as small as 4.3 nm.

Comparative Example 3

An ink jet recording medium was obtained in the same manner as in Example 1 except that instead of the silica/alumina composite sol A, the silica sol as its starting material (Cataloid SI-50, trade name, manufactured by Catalysts & Chemicals Industries Co., Ltd.) wherein spherical primary particles of silica having an average particle size of primary particles of 27 nm, were dispersed, was employed. With this silica sol, the specific surface area was 99 m$^2$/g, but the average pore radius was as small as 4.4 nm.

Comparative Example 4

A recording medium was obtained in the same manner as in Example 1 except that the silica/alumina composite particle layer as the upper layer, was not formed.

Comparative Example 5

An ink jet recording paper was obtained in the same manner as in Example 2 except that silica treated with aluminum polychloride having an average particle size of 129 nm, as disclosed in Example 1 in JP-A-2000-351267, was used instead of the silica/alumina composite sol A. The specific surface area of a xerogel obtained by drying this silica treated with aluminum polychloride, was 163 m$^2$/g, but the average pore radius was as small as 5.5 nm.

Comparative Example 6

An ink jet recording paper was obtained in the same manner as in Example 2 except that the silica/alumina composite particle layer as the upper layer was not formed.

Comparative Example 7

A duplication test of Example 4 (Comparative Example) of JP-A-2000-218924 was carried out. Firstly, the silica/alumina composite sol as disclosed in the Example in JP-A-2000-218924, was prepared. The obtained silica/alumina composite sol had an average particle size of 140 nm, and the pore characteristics of a xerogel obtained by drying this sol were such that the specific surface area was 165 m$^2$/g, but the average pore radius was as small as 5.8 nm. A recording medium was prepared in the same manner as in Example 4 (Comparative Example) in JP-A-2000-218924, on a paper having a thickness of 170 $\mu$m and a weight of 165 g/m$^2$.

Comparative Example 8

To 100 g of a dry-process silica having an average primary particle size of 7 nm (Aerosil 300, manufactured by Nippon Aerosil Co., Ltd.), 670 g of deionized water was added and stirred, followed by further dispersion by means of an ultrasonic dispersing machine, to obtain a silica dispersion having a concentration of 13 mass %. Then, 33.3 g of a cationic polymer (SPO-601, manufactured by Nihon Junyaku Co., Ltd., concentration: 30 mass %) was added while stirring this silica dispersion, and further, 278 g of a 9 mass % solution of polyvinyl alcohol (PVA-420, trade name, manufactured by Kuraray Co., Ltd., saponification degree: 82%, polymerization degree: 2000) was added.

Then, 37.5 g of a 1:1 mixed solution of a 4 mass % boric acid aqueous solution and a 4 mass % borax aqueous solution, was added to obtain a silica coating fluid having a total amount of 1118.8 g, a solid content ratio of silica/cationic polymer/PVA/boric acid/borax=100/10/25/0.75/0.75 and a total solid content concentration of 12.2 mass %. This coating fluid was coated on RC paper (CPF-170VE, trade name, manufactured by Mitsubishi Paper Mills Limited) as used in Example 2, by means of a slide hopper, so that the coated amount after drying would be 35 g/m$^2$ and then cooled to 5° C., whereby the coated fluid was gelled (immobilized). Then, the coated layer was dried by dry air of 50° C. to obtain an ink jet recording medium.

Example 5

The silica coating fluid of the above Comparative Example 8 was used as the coating fluid for a lower layer. On the other hand, to the silica/alumina composite sol B, an aqueous solution of polyvinyl alcohol (MA26-GP, manufactured by Shin-Etsu Chemical Co., Ltd.), boric acid and borax, were added in a ratio so that the solid content ratio would be 100:4:1.6:0.4, and water was further added thereto to obtain a coating fluid for an upper layer, having a total solid content concentration of 20 mass %. On the same substrate as in Comparative Example 8, the coating fluids were simultaneously coated by means of a slide hopper, so that the coated amounts after drying would be 35 g/m$^2$ for the lower layer and 1.7 g/m$^2$ for the upper layer, and then cooled to 5° C., whereby the coating fluids were gelled and immobilized. Then, the coated layers were dried by dry air of 50° C. to obtain an ink jet recording medium.

The properties of the recording media obtained in Examples and Comparative Examples are shown in Table 1.

Now, the methods for evaluation of sols and recording media, used in Examples of the present invention will be described.

Measurement of the Physical Properties of a Sol

For the concentration of a sol, the sol was dried at 140° C. until it became a constant weight, and the concentration of the sol was obtained from the weight difference between before and after the drying. The pH was investigated by means of a pH meter HM-12P, manufactured by Toa Denpa K.K. The average particle size of agglomerated particles was measured by means of a laser scattering particle measuring apparatus LPA-3000/3100 model, manufactured by Otsuka Electronics Co., Ltd.

Measurement of Pore Characteristics of a Xerogel

A sol was dried at 140° C. until it became a constant weight, to obtain a powder of a xerogel. This powder was deaerated under vacuum for two hours at 120° C. under a pressure of not higher than 13.3 Pa, and then, the specific surface area and the average pore radius were obtained by means of a nitrogen adsorption/desorption apparatus (Autosorb 3B mode, manufactured by Quantachrome Corp.).

Evaluation of Properties of a Recording Medium

Glossiness: 60° glossiness as stipulated in JIS Z8741, was measured by means of a handy gloss meter PG-1M, manufactured by Nippon Denshoku Kogyo K.K.

Color density: 100% solid printing with black (Bk), cyan (C), magenta (M) and yellow (Y) was carried out by a gloss film mode by means of a color printer PM-800C, manufactured by Seiko Epson Corporation, and the color densities were measured by means of a reflection color density meter of Macbeth AG (Gretag-Macbeth AG Spectrolino).

Ink absorptivity: 100% solid printing with black (Bk), cyan (C), magenta (M) and yellow (Y) was carried out by a gloss film mode by means of a color printer (PM-800C, manufactured by Seiko Epson Corporation), and the ink absorptivity was visually evaluated. Symbol ○ represents a case where no beading due to efficient absorption was observed in all colors, and symbol X represents a case where beading was observed in any one of the colors.

Scratch resistance: the color fastness against abrasion as stipulated in JIS L0849, was evaluated by an abrader model II (manufactured by Suga Test Instruments Co., Ltd.). An abrasion test was carried out by reciprocating a load of 2N for a distance of 100 nm of a test piece at a speed of 30 reciprocations per minute, whereupon the surface was visually observed, whereby a case where no scratch was observed, was judged that scratch resistance was good and represented by ○, and a case where scratches were observed, was represented by X. With respect to Comparative Example 2, no evaluation of scratch resistance was carried out.

TABLE 1

| | 60° | Color density | | | | Ink | Scratch |
|---|---|---|---|---|---|---|---|
| | glossiness | Bk | C | M | Y | absorptivity | resistance |
| Ex. 1 | 52 | 2.4 | 2.6 | 2.0 | 1.1 | ○ | ○ |
| Ex. 2 | 52 | 2.5 | 2.6 | 1.9 | 1.2 | ○ | ○ |
| Ex. 3 | 52 | 2.5 | 2.6 | 1.9 | 1.2 | ○ | ○ |
| Ex. 4 | 42 | 2.0 | 2.1 | 1.7 | 1.0 | ○ | ○ |
| Comp. Ex. 1 | 52 | 2.4 | 2.4 | 1.9 | 1.1 | X | ○ |
| Comp. Ex. 2 | 55 | 2.5 | 2.4 | 2.0 | 1.1 | X | — |
| Comp. Ex. 3 | 56 | 2.1 | 2.1 | 1.8 | 1.0 | X | ○ |
| Comp. Ex. 4 | 44 | 2.1 | 2.3 | 1.8 | 1.1 | ○ | X |

TABLE 1-continued

| | 60° | Color density | | | | Ink | Scratch |
|---|---|---|---|---|---|---|---|
| | glossiness | Bk | C | M | Y | absorptivity | resistance |
| Comp. Ex. 5 | 52 | 2.4 | 2.3 | 1.9 | 1.1 | X | ○ |
| Comp. Ex. 6 | 44 | 2.1 | 2.3 | 1.7 | 1.1 | ○ | X |
| Comp. Ex. 7 | 35 | 2.3 | 2.4 | 1.9 | 1.1 | X | ○ |
| Comp. Ex. 8 | 37 | 1.8 | 2.0 | 1.6 | 1.1 | ○ | ○ |
| Ex. 5 | 44 | 2.2 | 2.4 | 1.7 | 1.1 | ○ | ○ |

From Examples 1 to 4, it is evident that an ink jet recording medium having a high glossiness, high color density and good ink absorptivity, can be obtained by providing a silica/alumina composite particle layer having a specific average pore radius as the upper layer. In Comparative Examples 1, 5 and 7, the ink absorptivity is poor, since the average pore radius of a xerogel obtained by removing the solvent from the silica/alumina composite sol in the upper layer, is small. In Comparative Example 2, the average pore radius of the fine alumina particles in the upper layer was small, and in Comparative Example 3, the average pore radius of a xerogel obtained by removing the solvent from the silica sol, was small, whereby the ink absorptivity was poor.

Among Examples 1 to 4, the specific surface area was large in Examples 1 to 3, as compared with Example 4, whereby improvement in the glossiness and the color density was observed. In Comparative Examples 4 and 6, the silica/alumina composite particle layer of the present invention was not present as the upper layer, whereby not only the scratch resistance was poor, but also the glossiness and the color density were low. Comparative Example 7 shows that with a conventional silica/alumina composite sol, the average pore radius is small, whereby the ink absorptivity is poor, and the substrate is paper, whereby the glossiness is inadequate.

Example 5 shows that by providing a silica/alumina composite particle layer having a specific average pore radius as an upper layer on a porous layer composed of fine silica particles of Comparative Example 8, it is possible to obtain an ink jet recording medium having high glossiness, high color density and good ink absorptivity.

The recording medium of the present invention has a layer comprising silica/alumina composite particles and a binder, as the uppermost layer, whereby a recording medium excellent in ink absorptivity, image color density, water resistance, scratch resistance and glossiness, can be obtained. Particularly, it is possible to obtain a recording medium of a high quality, which has a high color density and high gloss and which is free from beading in a printing test.

What is claimed is:

1. An ink jet recording medium comprising a substrate, a porous ink receiving layer containing boehmite particles, formed on the substrate and a layer containing silica/alumina composite particles, formed on the ink receiving layer, wherein the layer containing silica/alumina composite particles, is a layer containing a xerogel having an average pore radius ranging from 6.0 to 15 nm, obtained by removing a solvent from a silica/alumina composite sol containing agglomerated particles comprising silica and alumina.

2. The ink jet recording medium according to claim 1, wherein the average pore radius of the xerogel is from 6.5 to 12 nm.

3. The ink jet recording medium according to claim 1, wherein the average pore radius of the xerogel is from 7.0 to 10 nm.

4. The ink jet recording medium according to claim 1, wherein the specific surface area of the xerogel is from 50 to 200 $m^2/g$.

5. The ink jet recording medium according to claim 1, wherein the substrate is a water-impermeable substrate.

6. The ink jet recording medium according to claim 4, wherein the substrate is a water-impermeable substrate.

7. The ink jet recording medium according to claim 5, wherein the water-impermeable substrate is a polyethylene terephthalate film.

8. The ink jet recording medium according to claim 5, wherein the water-impermeable substrate is a resin-coated paper having a polyolefin resin coating layer.

* * * * *